United States Patent [19]

Allen et al.

[11] 3,991,828

[45] Nov. 16, 1976

[54] THERMAL RECOVERY METHOD

[75] Inventors: Joseph C. Allen, Bellaire; Yick-Mow Shum, Houston, both of Tex.

[73] Assignee: Texaco Inc., New York, N.Y.

[22] Filed: Sept. 23, 1974

[21] Appl. No.: 508,378

[52] U.S. Cl. ..... 166/261; 166/272

[51] Int. Cl.[2] ..... E21B 43/24

[58] Field of Search ..... 166/261, 272, 303

[56] References Cited

UNITED STATES PATENTS

| | | | |
|---|---|---|---|
| 2,788,071 | 4/1957 | Pelzer | 166/261 |
| 2,839,141 | 6/1958 | Walter | 166/261 |
| 2,958,519 | 11/1960 | Hurley | 166/261 |
| 3,171,479 | 3/1965 | Parrish et al. | 166/261 |
| 3,208,519 | 9/1965 | Moore | 166/261 |
| 3,292,702 | 12/1966 | Boberg | 166/303 |
| 3,369,604 | 2/1968 | Black et al. | 166/261 |
| 3,409,077 | 11/1968 | Durie | 166/303 |
| 3,411,578 | 11/1968 | Holmes | 166/303 |
| 3,563,312 | 2/1971 | Zwicky | 166/261 |
| R27,252 | 12/1971 | Sklar et al. | 166/261 |

*Primary Examiner*—Ernest R. Purser
*Assistant Examiner*—Jack E. Ebel
*Attorney, Agent, or Firm*—T. H. Whaley; C. G. Ries; Kenneth R. Priem

[57] ABSTRACT

A method for recovering low gravity viscous crude oil or bitumen from a subterranean formation comprising first injecting super heated steam, next initiating an in situ combustion by injecting air, followed by an in situ combustion wherein both super heated steam and air are injected, then simultaneously performing an in situ combustion by injecting air while also injecting water and finally injecting water.

1 Claim, 4 Drawing Figures

THERMAL ADVANCE - TIME RELATIONS

360 DAYS · SUPERHEATED STEAM
TEMPERATURE, °F
2,000
1,800
1,600
1,400
1,200
1,000
800
600
400
200
0
0
32.0
96.0
160.0
224.0
288.0
DISTANCE FROM INJECTION WELL, FEET

72 DAYS SUPERHEATED STEAM
288 DAYS SUPERHEATED STEAM PLUS AIR
TEMPERATURE, °F
2,000
1,800
1,600
1,400
1,200
1,000
800
600
400
200
0
0
32.0
96.0
160.0
224.0
288.0
DISTANCE FROM INJECTION WELL, FEET

72 DAYS · SATURATED STEAM
72 DAYS · SATURATED STEAM PLUS AIR
216 DAYS · AIR AND 200°F WATER
TEMPERATURE, °F
2,000
1,800
1,600
1,400
1,200
1,000
800
600
400
200
0
0
32.0
96.0
160.0
224.0
288.0
DISTANCE FROM INJECTION WELL, FEET

THERMAL RECOVERY METHOD

BACKGROUND OF THE INVENTION

1. Field of the Invention

This invention pertains to the field of viscous petroleum recovery.

2. Description of the Prior Art

This invention is an improved method for the recovery of oil from subterranean hydrocarbon bearing formations wherein the oil is very viscous, that is, it has a low API gravity or is a bitumen. This method is especially useful for recovering hydrocarbons from reservoirs such as tar sand formations.

The recovery of very viscous oil from formations and bitumens from tar sands has generally been difficult if not impossible on a commercial scale. Although some advances have been realized in recent years in stimulating the recovery of heavy oils, i.e., oils having an API gravity in the range of 10° to 25° API, little success has been realized in recovering bitumens from tar sands. Bitumens are generally regarded as being highly viscous oils having a gravity in the range of about 4° to 10° API and are contained in an essentially unconsolidated sand referred to as a tar sand. Vast quantities of tar sand exists in the Athabasca region of Alberta, Canada. Although these deposits contain several hundred billion barrels of oil or bitumen, the recovery of this bitumen using conventional in situ techniques has been less than successful. The reasons for this lack of success relates primarily to the fact that bitumen is extremely viscous at the temperature of the formation with consequently low mobility. In fact, the bitumen is so viscous that it appears to be a soft solid. In addition, these tar sand formations have very low permeability even though they are unconsolidated.

Using the principal that the viscosity of oil decreases with an increase in temperature, prior art techniques have usually been designed with the idea of raising the temperature of the bitumen in situ. This improves its mobility and therefore its amenability to recovery. These thermal recovery techniques generally include steam injection and hot water injection as well as in situ combustion.

Usually these techniques employ an injection well and a production well spaced apart from each other and penetrating an oil bearing formation. In the usual steam operation involving two wells, the steam is introduced into the formation through the injection well and the heat from the steam is transferred to the bitumen (if a tar sand is involved) thus lowering its viscosity and therefore improving mobility while the flow of the hot fluid in the injection well drives the bitumen toward the production well from which it may be produced.

Normally, in an in situ combustion operation, an oxygen containing gas, such as air is introduced into the formation through an injection well and combustion of the in place crude adjacent to the well bore is initiated by one of many known means such as the use of a downhole gas fired heater or a downhole electric heater or in some cases chemical means. Thereafter, the injection of oxygen containing gas is continued to maintain a combustion front which is formed, and to drive the front through the formation toward the production well.

Ideally, as the combustion front advances through the formation, a swept area is formed consisting of a clean sand matrix behind the front. Ahead of the advancing front various contiguous zones are formed and are also displaced ahead of the combustion front. These zones may be envisioned as a distillation and cracking zone near the front, a vaporization and condensation zone farther from the front, an oil bank even farther from the front, and lastly an unaltered zone.

The temperature at the combustion front is generally very high ranging from 650° to 1200° F. The heat thus generated in this zone is transferred to the distillation and cracking zone just ahead of the combustion front where the crude or bitumen undergoes some distillation and cracking. In this zone a sharp thermal gradient is thought to exist wherein the temperature drops from the temperature of the combustion front to about 300° to 450° F. As the front progresses through the formation, the temperature of the formation continues to rise and the heavier molecular weight hydrocarbons of the oil become carbonized and are deposited on the matrix of the formation. These carbonized hydrocarbons are the potential fuels to sustain the progressive in situ combustion zone.

Ahead of the distillation and cracking zone is a vaporization and condensation zone. This zone is a thermal plateau and its temperature is in the range of from about 200° to about 450° F depending upon the distillation characteristics of the fluid in the formation and the formation pressure. These fluids consist of water and steam and hydrocarbon components of the crude or bitumen.

Ahead of the vaporization and condensation zone is an oil bank which fills up as the in situ combustion front progresses and the formation of crude is displaced toward the production well. This zone is highly oil saturated but contains not only reservoir fluids but also condensate, cracked hydrocarbons and gases which are products of combustion which eventually reach the production well from which they may be produced.

Although in situ combustion has been used to increase recovery of bitumen and viscous crudes, variations of the technique have taken place in order to improve its performance, for example, water or saturated steam is sometimes injected with the air. See for example, U.S. Pat. No. 2,584,606. This is sometimes referred to as wet combustion. This has improved the process somewhat. However, the method has several weaknesses which will limit the process to only a very few reservoirs. It has been found, for example, that the wet process is restricted to relatively heavy crudes containing very high molecular weight hydrocarbons, thick reservoirs and very close well spacing, which contribute to very high costs.

In addition, U.S. Pat. No. 2,839,141 suggests that super heated steam injection and in situ combustion with super heated steam is a way to displace heavy oils. However, this method also has limitations. Even though it conducts a great deal of heat initially into the formation, it connot displace all of the oil in the swept zone and since the super heated zone cannot propagate over great distances from the well bore, it also requires close well spacing.

Laboratory models utilizing simultaneous injection of super heated steam and air have recovered over half of the bitumen in place. Although these results are an improvement over the simple wet in situ combustion, it has the same limitations as the separate method, that is, it leaves behind in the swept zone a significant quantity of combustible material. There is always a significant degree of vertical permeability, variation especially in tar sand reservoirs, which causes the thermal front to migrate through only a portion of the oil saturated interval. As a result heat loss is high which prevents the thermal front from propagating at great distances from the injection well. In the case of in situ combustion, the combustion front will finally cease when the vertical combustion interval narrows down to about 4 feet.

Our invention proposes a method which will be an improvement over prior art methods in that it will eliminate many of the disadvantages which render them ineffective in some cases. The objectives of our invention are to increase the distances of the propagation of very high temperature fronts thereby reducing the necessity for a large number of wells, to increase the efficiency of the thermal method and to increase the thermal conformance in both the vertical and horizontal planes.

SUMMARY OF THE INVENTION

Figure 1:
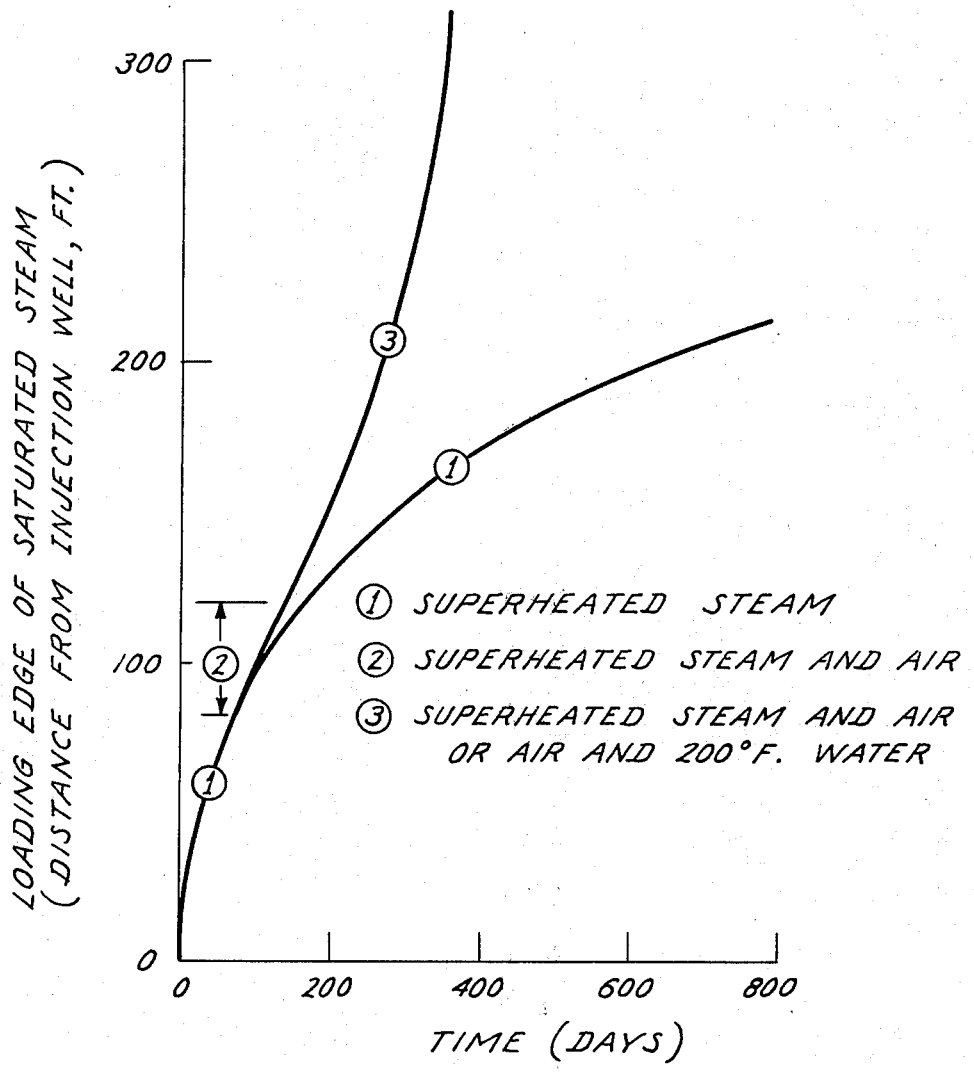
FIG. 1 depicts the leading edge of saturated steam as distance from a well bore.

The invention is a method for recovering hydrocarbons such as low gravity viscous crude oil or bitumen from a subterranean reservoir penetrated by at least one injection well and at least one production well comprising the steps of:

a. injecting super heated steam into the formation via said injection well, b. terminating injection of said super heated steam and initiating injection of air to establish an in situ combustion front in said reservoir, c. continuing injection of said air to support the in situ combustion front and resuming injection of super heated steam at the said injection well, d. terminating injection of said super heated steam and initiating injection of water along with the air to continue an in situ combustion front, e. terminating air injection to discontinue the in situ combustion front while continuing to inject water into said injection well and f. producing said hydrocarbons from said production well.

DESCRIPTION OF THE PREFERRED EMBODIMENTS

In one embodiment of our invention, an in situ combustion operation using super heated steam and air procedes an in situ combustion operation using water and/or saturated steam.

In another embodiment of our invention, an in situ combustion operation precedes injection of super heated steam and an in situ combustion operation using water and/or saturated steam.

In other embodiments of our invention, the above embodiments are terminated using a final sweep of water to scavenge heat from the formation.

The term air used herein is used for convenience and includes not only air comprising mainly nitrogen and oxygen but any oxygen containing gas which may be used.

The most preferred method of our invention involves several steps which comprise the following:

1. Super heated steam injection;
2. Air injection (in situ combustion);
3. Simultaneous super heated steam and air injection (in situ combustion);
4. Simultaneous air (in situ combustion) and water injection; and
5. Water injection.

The method of our invention including all of the steps in order listed above is superior to any of the steps taken singly or in lesser combination.

Utilizing a computational model and computer program we will demonstrate the technical superiority of our method. Table I below lists the reservoir injection data that were used in the computational model.

TABLE I

| | |
|---|---|
| Reservoir Data | |
| Formation thickness | 26 ft. |
| Thermal capacity | 35 BTU/ft.$^3$ ° F |
| Thermal conductivity | 1 BTU/hr. ft. ° F |
| API gravity of crude oil | 18.6° |
| Initial reservoir temperature | 80° F |
| Kh | 1.1 darcy - ft. |
| Distance between injection well and producing well (in an inverted 5 spot) | 320 ft. |
| Injection Data | |
| Injection pressure | 500 psig |
| Producing well pressure | 200 psig |
| (1) Superheated steam injection rate | 400 B/D at 700° F |
| (2) Superheated steam injection + air injection: Steam at 400 B/D at 700° F Air at 1.84 MMSCF/D | |
| (3) Hot water injection + air injection Hot water at 400 B/D at 200° F Air at 1.84 MMSCF/D | |

Figure 2:
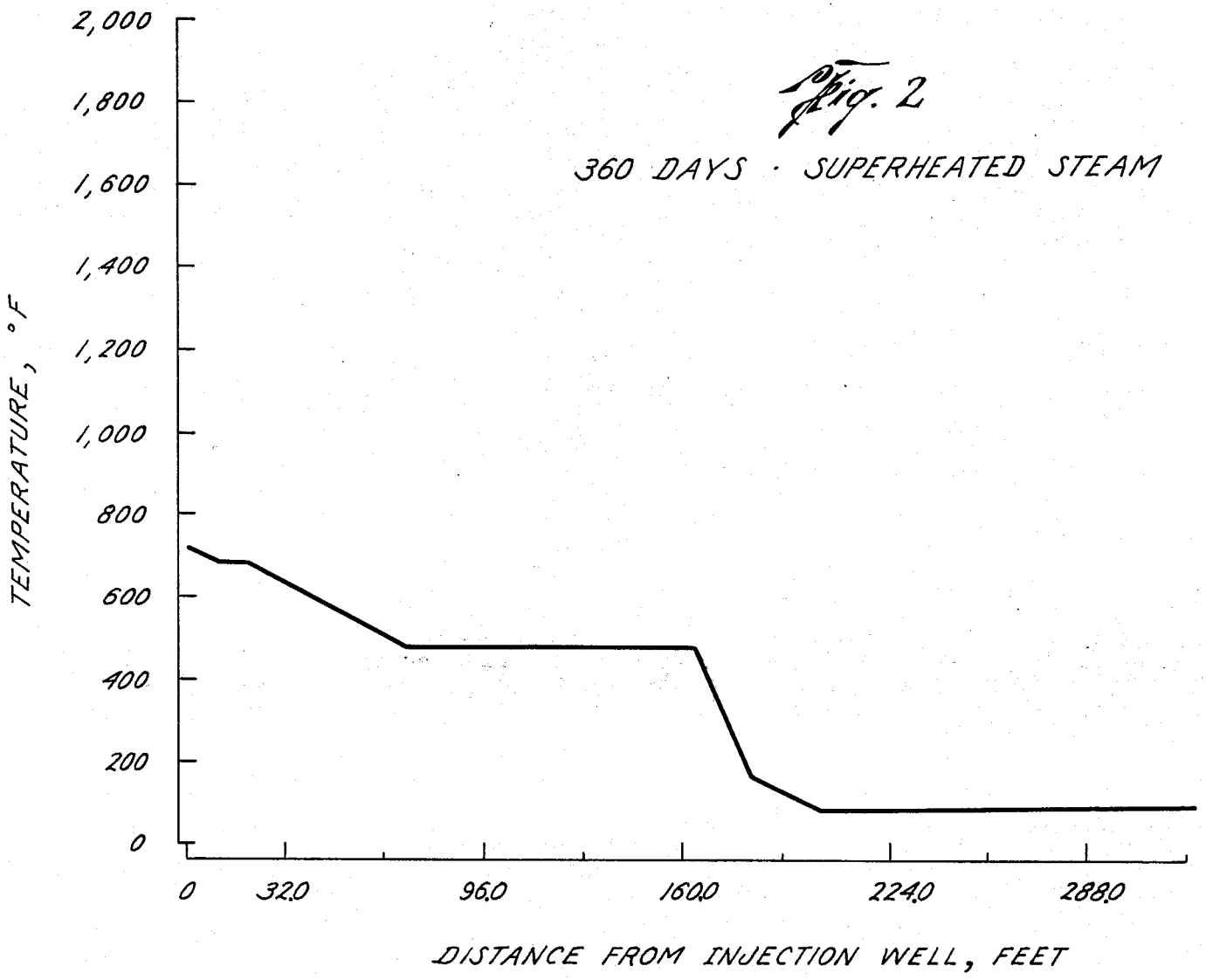
FIG. 2 shows the thermal effect on the formation of injecting super heated steam only.
Figure 3:
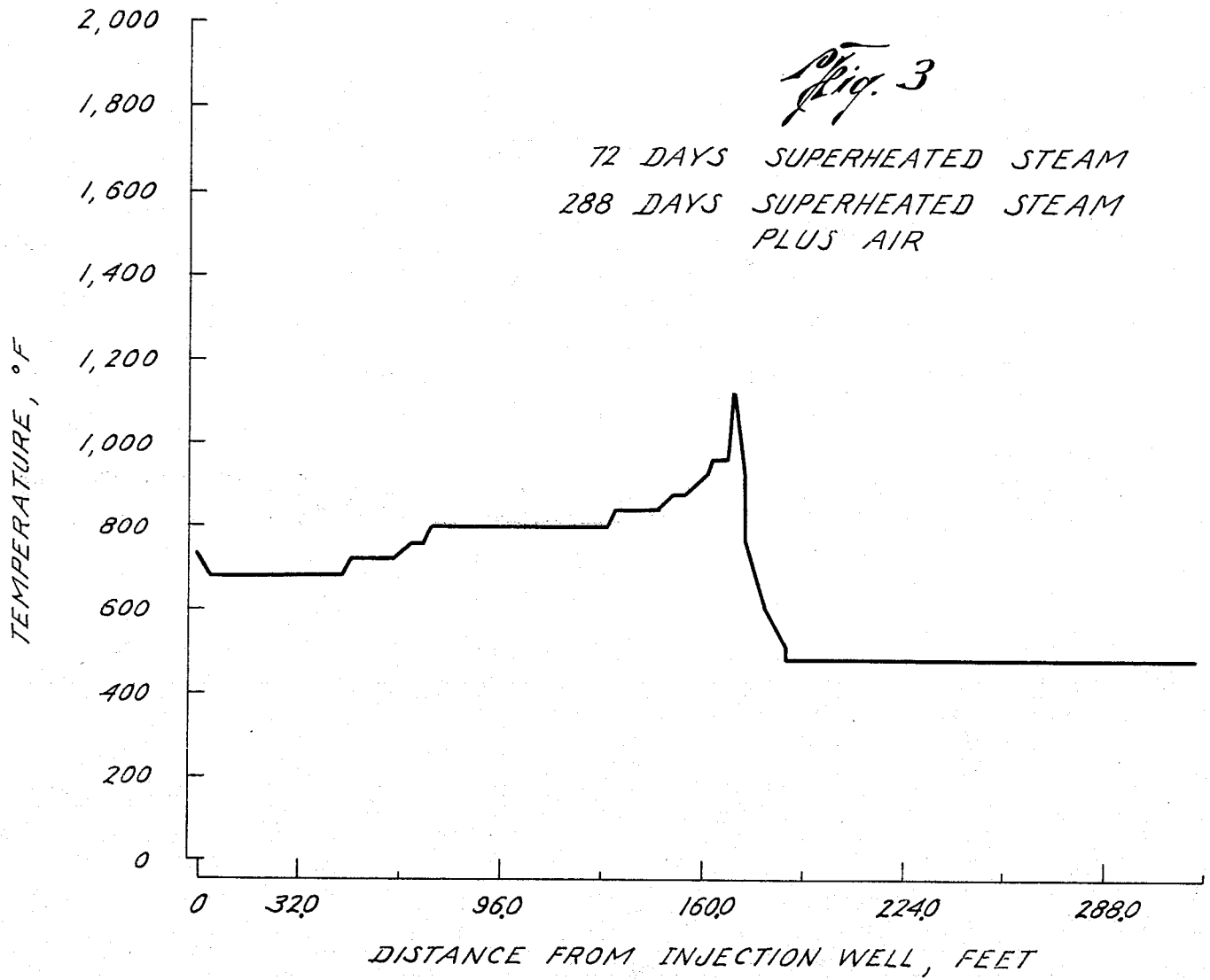
FIG. 3 shows the effect of super heated steam followed by super heated steam plus air.

Computations may best be displayed by the graphical representations FIGS. 1–4. FIG. 1 shows the leading edge of the saturated steam zone as distance from the injection well versus time. Curve 1 of FIG. 1 represents super heated steam alone. The curve 2 segment is for super heated steam plus air from 72 to 144 days of the operation. Curve 3 is for super heated steam and air or air and 200° F water injection after 144 days have elapsed. It is noted that the introduction of the situ combustion speeds up the advance of the thermal front. Combination of in situ combustion with super heated steam drastically increases the velocity of the thermal front which increases oil and production rates and recovery. A distinct advantage is obtained by augmenting super heated steam with in situ combustion. All oil bearing formations have a vertical permeability distribution. Therefore, injected fluids traverse through only a minor portion of the vertical interval taking the path of least resistance. The oil bearing beds adjacent to the invaded thermal zones are heated, however, and a substantial amount of oil is produced therefrom. Heat transport from the hot zone to the cooler uninvaded zone varies directly with the temperature of the hot zone, the areal extent of the hot zone and the time of the uninvaded zone's exposure to the hot zone. The dramatic increase in thermal front advance rate as shown by Curve 3 over Curve 1 of FIG. 1 is evident. FIG. 2 shows the computer calculation of a temperature profile from the injection well to a production well 320 feet apart. After 360 days of injecting super heated steam at 700° F, formation is heated to that value (700° F) for only a short distance from the injection well. A rather long saturated steam temperature plateau is established, however, the formation is heated only halfway to the production well. FIG. 3 is also a plotted temperature profile for 360 days of thermal drive. For this case, however, 72 days of super heated steam injection was followed by super heated steam plus air injection for another 288 days for a total of 360 days as in FIG. 2. A study of FIG. 3 discloses that a much higher thermal front advance rate has been obtained over that of FIG. 2 which was for super heated steam along. Also, much more heat is introduced into the formation. This is determined by intergration of the curve. Also a much higher temperature differenc (Delta T) over a greater aerial extent exists. The higher thermal front advance rate and the greater amount of heat in the formation increase oil production rate and recovery directly. The great difficulty in propagating any thermal front in a piston-like manner makes the higher Delta T extremely effective in heating, moving and recovering oil in the adjacent uninvaded oil saturated bed.

Figure 4:
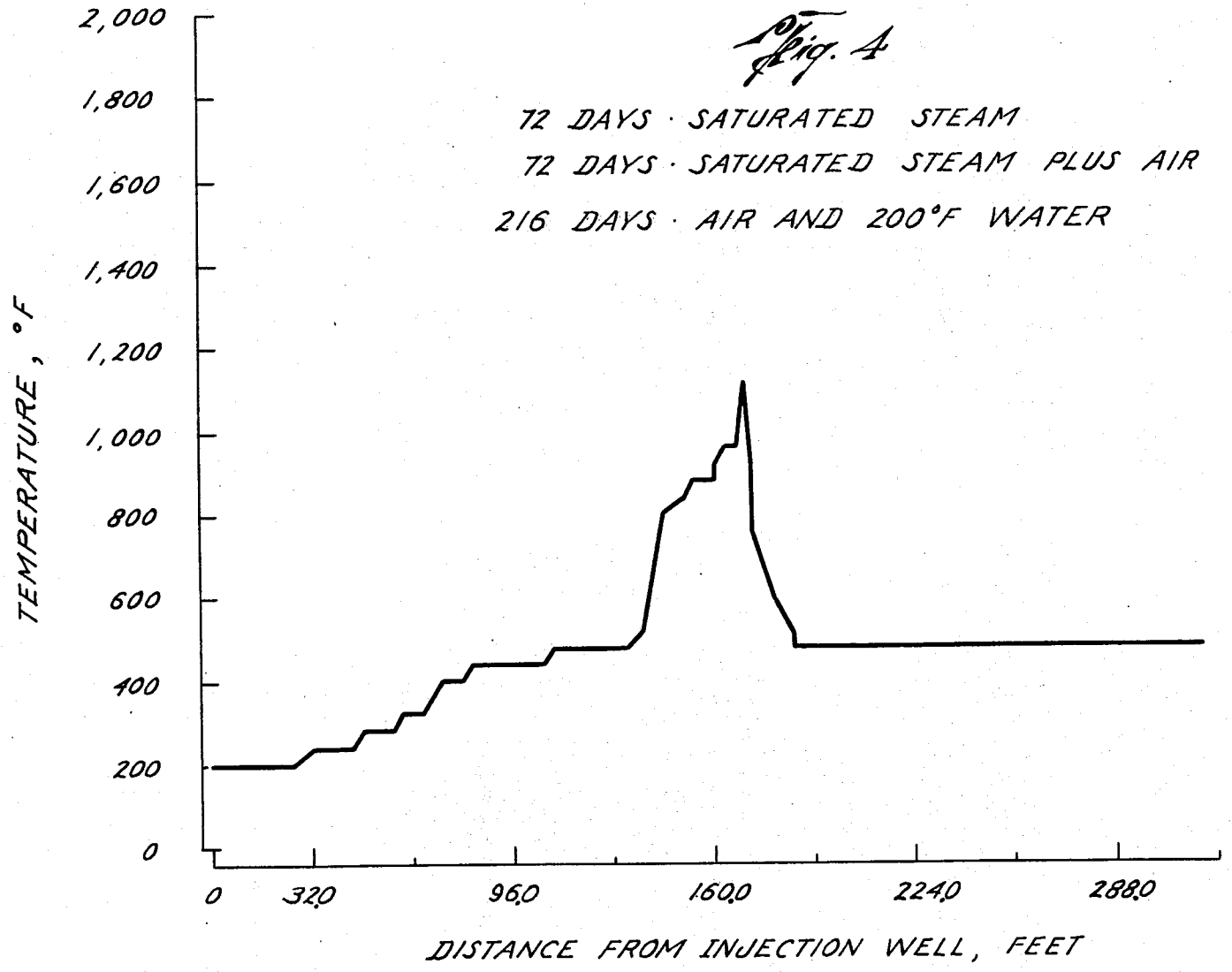
FIG. 4 shows the effect of using a saturated steam followed by saturated steam plus air.

The superiority over the simple wet combustion process which consists of in situ combustion followed by in situ combustion and water injection is proven by comparing the results on FIG. 3 with the results on FIG. 4. Although the advance rate of the saturated steam front is the same for the wet combustion process, the amount of heat in the formation and aerial extent of a very high temperature gradient between swept and unswept zones are much higher for the process of FIG. 3 than for the wet combustion process (FIG. 4). This increases oil recovery and production rate in the case of our process.

In addition to the above features, displaying advantages over the wet combustion process, pretreating with super heated steam injection will convert many formations from non-combustible to formations which will initiate and propagate an in situ combustion front. The super heated steam will open up at larger vertical intervals for burning and store up adequate heat in the formation for good propagation of the combustion during the earlier stages of the project which is very critical to success. Fuel studies using in situ combustion after injection of 80% quality steam have shown that considerable extraneous heat had to be supplied along with the air in order to ignite the formation. In fact the temperature near the injection well bore actually decreased during the early phase of hot air injection. Having water in the formation much heat was utilized in vaporizing the water which is necessary prior to combustion. Our process eliminates this detrimental feature by vaporizing all water near the well bore with super heated steam initially having the formation very dry, combustion is assured not only in the most receptive but also in less permeable sections.

Thus, our method is also superior to simultaneous super heated steam and air injection alone for the following reasons:

1. Higher temperatures are attained;
2. Higher temperature gradients are achieved;
3. Heat transport to the formation is high; and
4. More of the original combustible material is utilized for increasing rate and recovery.

We claim:

1. A method for recovering hydrocarbons such as low gravity viscous crude oil or bitumen from a subterranean reservoir penetrated by at least one injection well and at least one production well comprising the steps of:

a. injecting via said injection well super heated steam into the formation,
b. terminating injection of said super heated steam and initiating injection of air to establish an in situ combustion front in said reservoir,
c. continuing injection of said air to support the in situ combustion front and resuming injection of super heated steam into said injection well,
d. terminating injection of said super heated steam and initiating injection of water along with the air to continue an in situ combustion front,
e. terminating air injection to discontinue the in situ combustion front while continuing to inject water into said injection well and
f. producing said hydrocarbons from said production well.

* * * * *